US005846100A

United States Patent [19]

Ogawa

[11] Patent Number: 5,846,100

[45] Date of Patent: Dec. 8, 1998

[54] SOCKET FOR CONNECTION OF AN ELECTRICAL UNIT WITH A CONNECTOR

[75] Inventor: Shinji Ogawa, Yokkaichi, Japan

[73] Assignee: Sumitomo Wiring Systems, Ltd., Japan

[21] Appl. No.: 839,448

[22] Filed: Apr. 14, 1997

[30] Foreign Application Priority Data

Apr. 25, 1996 [JP] Japan ..... 8-105520

[51] Int. Cl.[6] ..... H01R 13/405

[52] U.S. Cl. ..... 439/736; 439/699.2

[58] Field of Search ..... 439/699.2, 619, 439/736, 604, 606, 667

[56] References Cited

U.S. PATENT DOCUMENTS

| | | | |
|---|---|---|---|
| 4,871,331 | 10/1989 | Kondo et al. | 439/736 |
| 5,080,615 | 1/1992 | Kondo | 439/699.2 |
| 5,350,322 | 9/1994 | Kondo | 439/736 |
| 5,509,828 | 4/1996 | Muta et al. | 439/699.2 |
| 5,595,513 | 1/1997 | Kondo | 439/736 |
| 5,637,020 | 6/1997 | Ito | 439/699.2 |

FOREIGN PATENT DOCUMENTS

| | | |
|---|---|---|
| 0642196 | 3/1995 | European Pat. Off. . |
| 11147644 | 4/1963 | Germany . |
| 222951 | 6/1990 | Japan . |
| 756824 | 6/1995 | Japan . |

*Primary Examiner*—Gary F. Paumen

*Attorney, Agent, or Firm*—Jordan B. Bierman; Bierman, Muserlian and Lucas

[57] ABSTRACT

A socket intended to receive and make electrical contact between an electrical unit, such as a wedge based light bulb, and a connector. A core including an inner cylinder is provided with an insertion opening at one end. There is an electrically conductive terminal which includes a unit contact at the distal end within the inner cylinder and adjacent the insertion opening. A connector contact extends from the proximal end of the conductive terminal, remote from the distal end, through a terminal hole in the inner cylinder, out of the interior space, and into a connector receiver. The terminal is provided with contacts to receive the unit, and a wall plate adjacent the inner side wall of the inner cylinder. In addition, there is a shield plate adjacent a proximal end which overlies the terminal hole, thereby preventing entry of molding resin into the interior space where it can impair the integrity of the connection.

11 Claims, 12 Drawing Sheets

SOCKET FOR CONNECTION OF AN ELECTRICAL UNIT WITH A CONNECTOR

This Application claims the benefit of the priority of Japanese Application 8-105520, filed Apr. 25, 1996.

The present Invention is directed to a device for receiving an electrical unit at one end and a connector at the other. The Invention will be described primarily with reference to a bulb, especially one with a wedge-shaped base, but it is understood that any suitable electrical unit can be used in conjunction therewith.

BACKGROUND OF THE INVENTION

Numerous bulb sockets of various shapes and configurations have been known to the prior art. However, some of these are exceedingly complex and expensive to manufacture. Therefore, it is an object of the present Invention to provide a bulb socket which is easy and inexpensive to produce.

SUMMARY OF THE INVENTION

The present Invention is directed to a socket which is adapted to receive and make electrical contact with a light bulb and a connector. It is composed of a core, which includes a hollow inner cylinder defining an interior space. A conductive terminal is located in the space extending from a bulb insertion opening at one end, through a terminal hole in the inner cylinder, into a connector receiver. The distal end of the conductive terminal is located in the interior space, adjacent the bulb insertion opening. The other end of the terminal is protected by the connector receiver; the connector can be inserted therein in order to make suitable contact therewith.

The conductive terminal includes a pair of electrode terminals which are spring loaded toward each other in order to make good electrical contact with the bulb. There is also a wall plate which fits adjacent the inner side of the wall of the inner cylinder and fits into an offset adjacent the other end. In addition, a shield plate is provided which overlies the terminal hole after the conductive terminal has been fully inserted. This prevents entry of resin during the insert molding process.

In a preferred form of the Invention, the wall is axially shortened at the end adjacent the shield plate. This provides room for a folded portion at the edge of the shield plate to fit without lengthening the inner cylinder.

It has also been found desirable to provide a pair of inner cylinders, adjacent each other, with their axes substantially parallel. Most usefully, a partition is provided between the inner cylinders to protect against accidental short circuiting. Moreover, although the cross section of the inner cylinder can vary substantially, it has been found most desirable that it be rectangular.

In a further embodiment of the Invention, the walls are extended in the direction away from the shield plate to form insertion legs which are substantially parallel to the axes. These can be inserted into corresponding grooves in the mold in order to accurately and reliably position the inner cylinder for molding of the surrounding portions of the socket.

BRIEF DESCRIPTION OF THE DRAWINGS

In the accompanying drawings, constituting a part hereof and in which like reference characters indicate like parts.

DETAILED DESCRIPTION OF THE INVENTION

Figure 1:
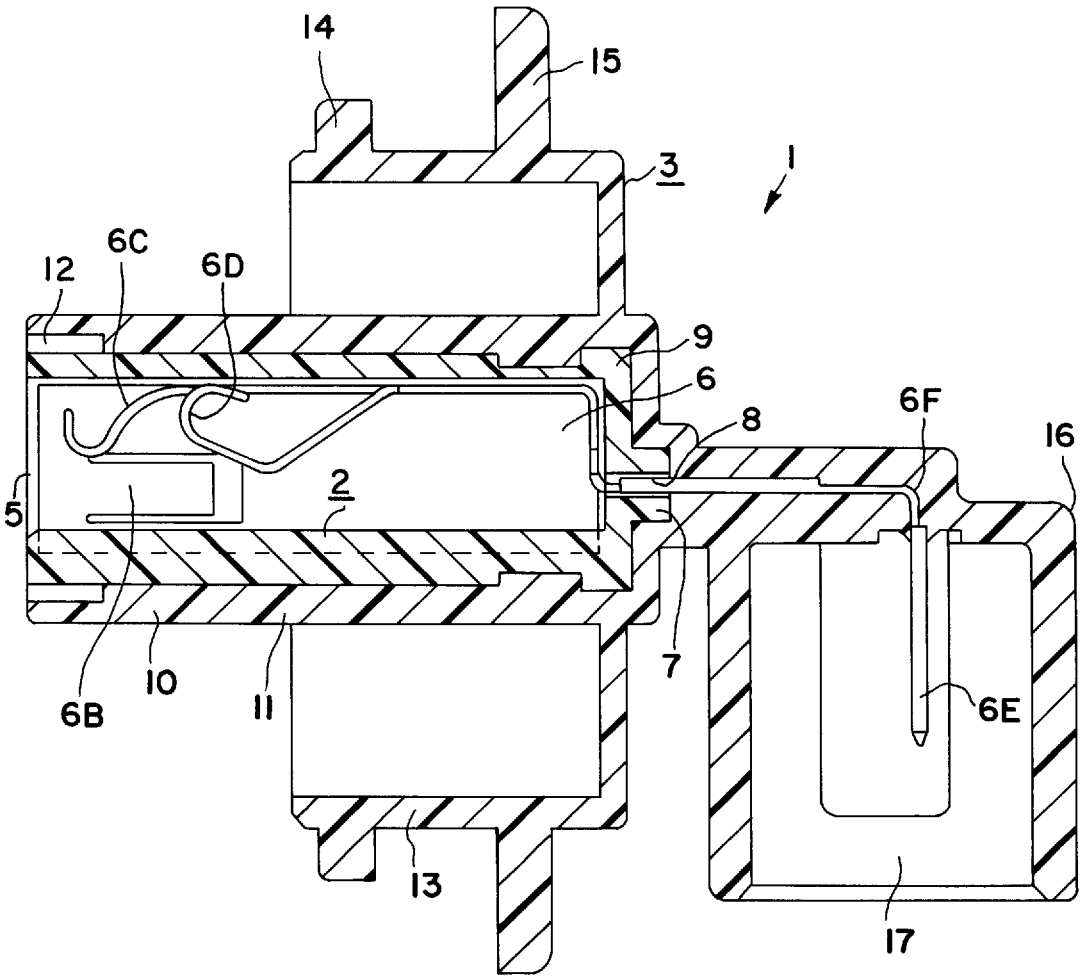
FIG. 1 is a cross section of one embodiment of the socket of the present Invention.

Referring more specifically to FIGS. 1 to 7, socket 1 comprises core 2, outer cylindrical shell 3, and connector receiver 16. Core 2 includes conductive terminal 6 which extends through terminal hole 8 and into connector receiver 16. Core 2 is provided with bulb insertion opening 5 at the end opposite terminal hole 8.

Conductive terminal 6 comprises wall plate 6A, pressing piece 6B, long elastic piece 6C, and short elastic piece 6D. Connector contact 6E extends into connector receiver 16 and is provided with bending section 6F which is more pliable than the remaining sections of conductive terminal 6.

Figure 6:
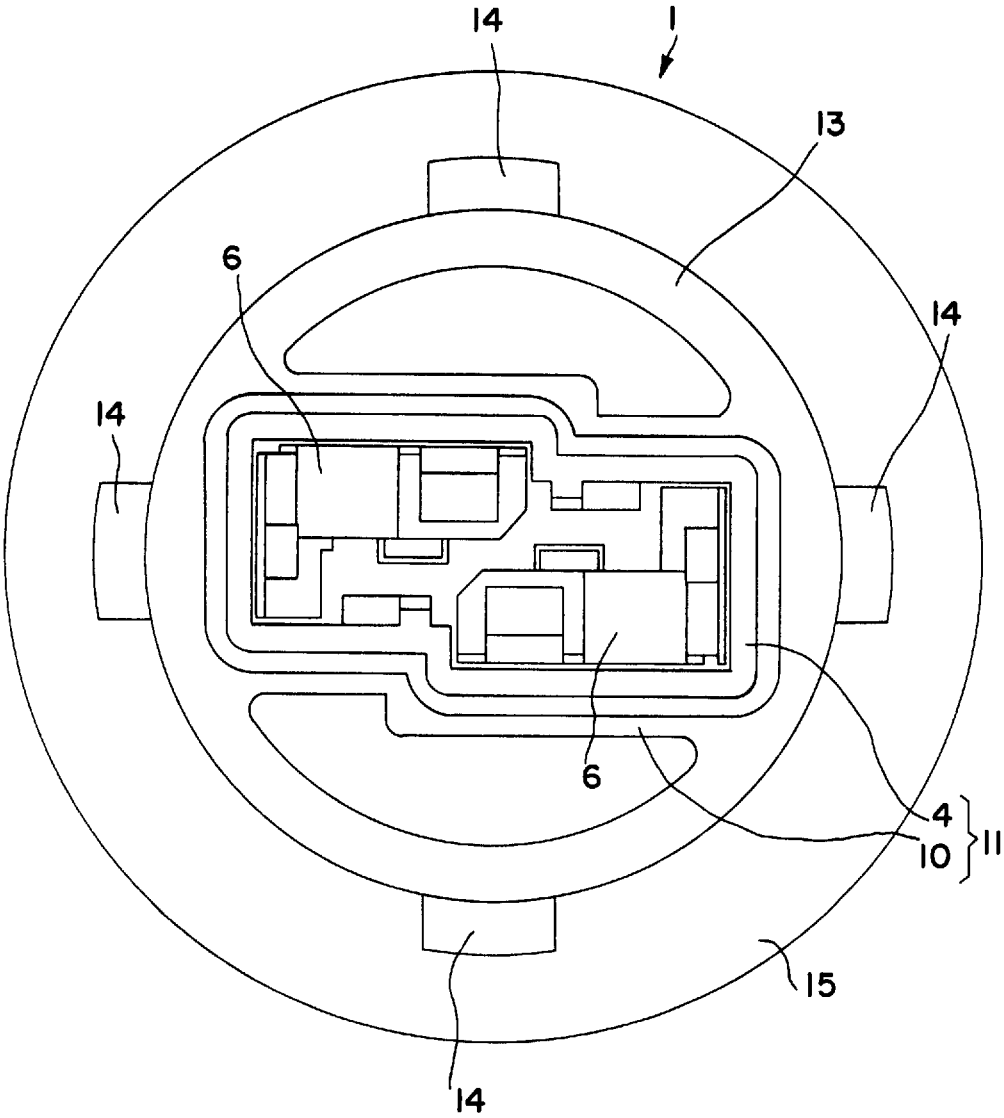
FIG. 6 is a plan view of the bulb socket.

Outer cylinder 10 surrounds inner cylinder 4 and is provided with overflow groove 12 adjacent insertion opening 5. The overflow groove is intended to receive any resin which would otherwise enter the space within inner cylinder 4 and thus impair the integrity of the connection between conductive terminal 6 and the bulb being inserted (not shown). Core 2 is provided, at the end remote from opening 5, with projection 7 and projecting rim 9 which serve to lock core 2 within outer cylinder 10. As best shown in FIG. 6, outer shell 13 is provided with flange 15 and four engagement projections 14.

Figure 7:
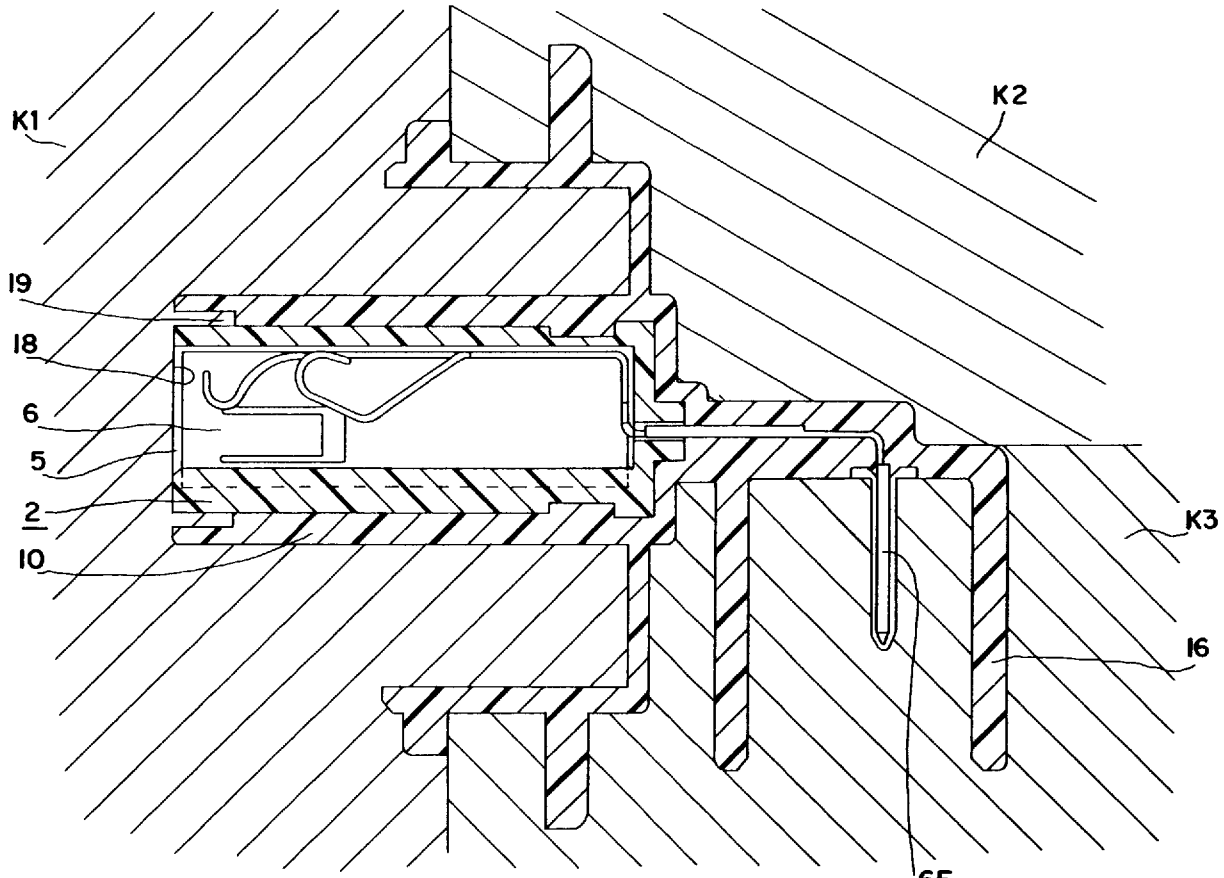
FIG. 7 is a cross section, similar to that of FIG. 1, showing the socket in its molds.
Figure 8:
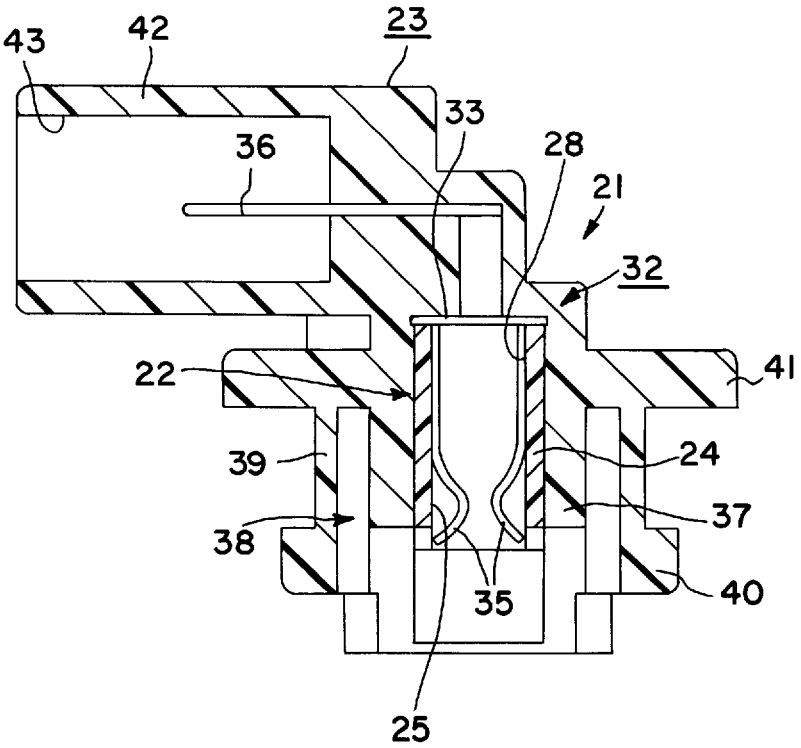
FIG. 8 is a cross section of a second embodiment of the present Invention.
Figure 9:
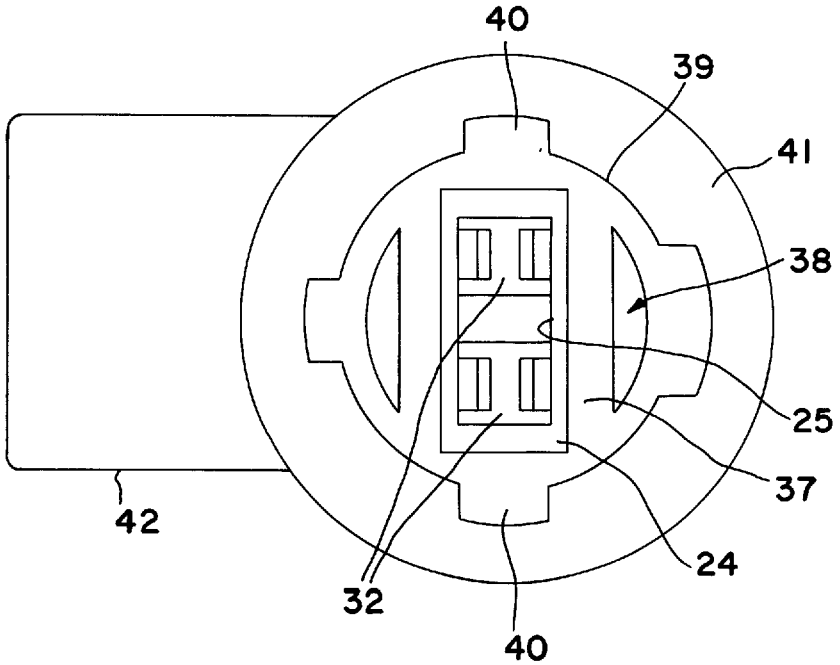
FIG. 9 is a bottom view of the bulb socket.
Figure 10:
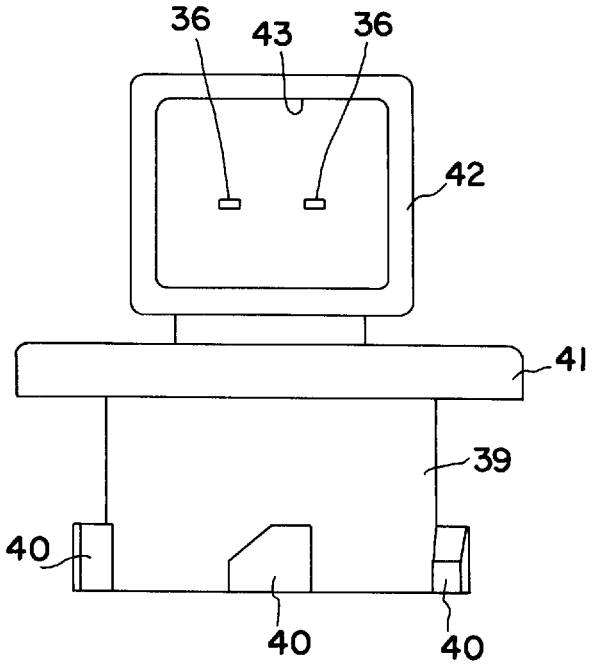
FIG. 10 is a view from the left of FIG. 8 of the bulb socket.

The socket of the present Invention is best manufactured by insertion molding. As is best shown in FIG. 7, core 2 is placed in molds K1, K2, and K3. The molds have cavities such that they are adapted to produce outer shell 3, outer cylinder 10, and connector insertion portion 16. Mold K1 is provided with molding surface 18 and projection rim 19. The former is in contact with insertion opening 5 of core 2 and effectively prevents resin from contacting conductive terminal 6. In addition, projection rim 19 forms overflow groove 12 (see FIG. 1) to receive excess resin.

Conductive terminal 6 is inserted through insertion opening 5 into inner cylinder 4. Connector terminal 6E and bending portion 6F are as shown in solid lines in FIG. 2. This makes it easy to pass these portions of conductive terminal 6 through terminal hole 8. Thereafter, connector terminal 6E is bent into the position shown in broken lines; the pliability of bending portion 6F assists in carrying out this step.

Figure 2:
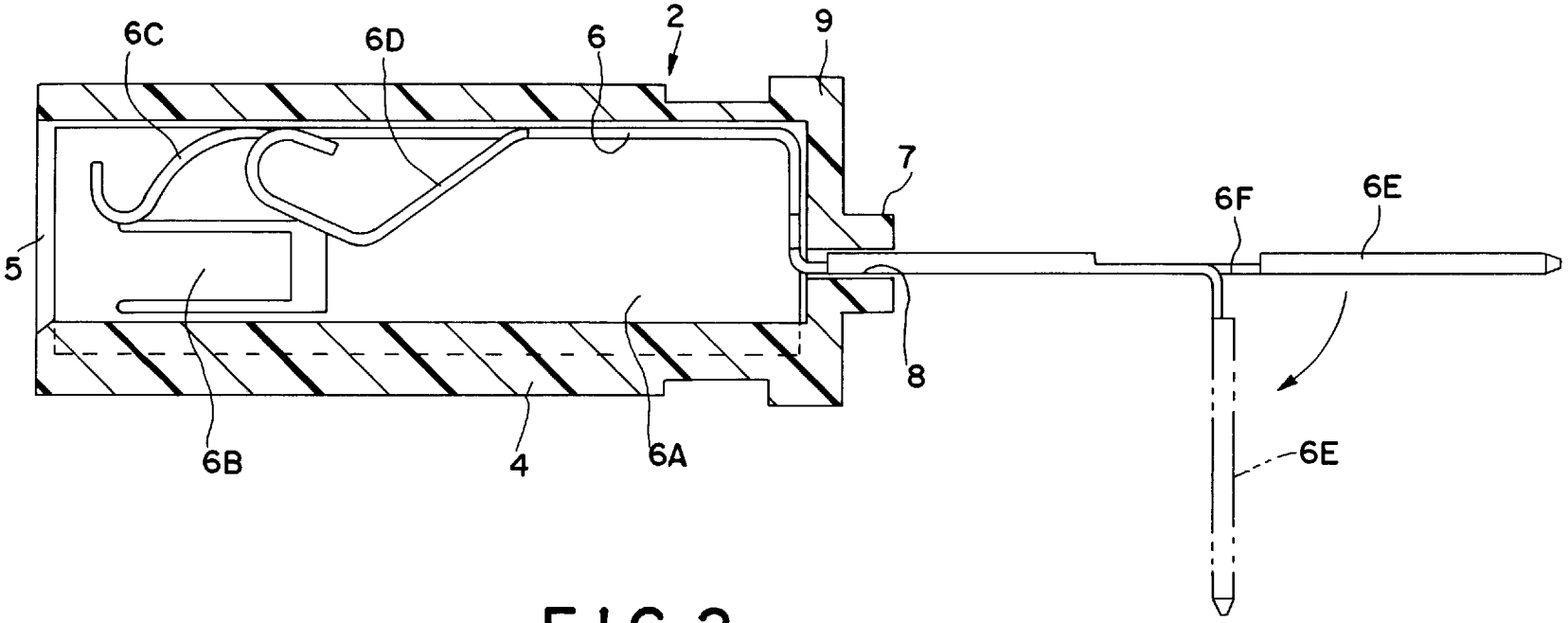
FIG. 2 is an enlarged view of the core of the socket of FIG. 1.
Figure 3:
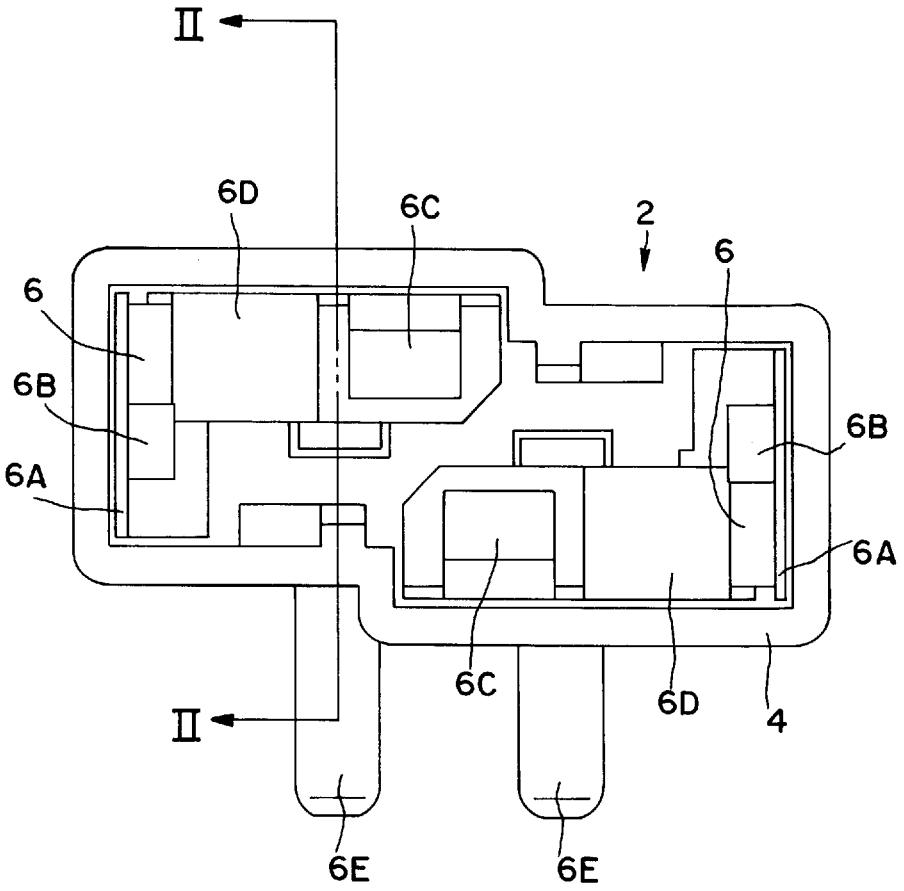
FIG. 3 is a front view of the core.
Figure 4:
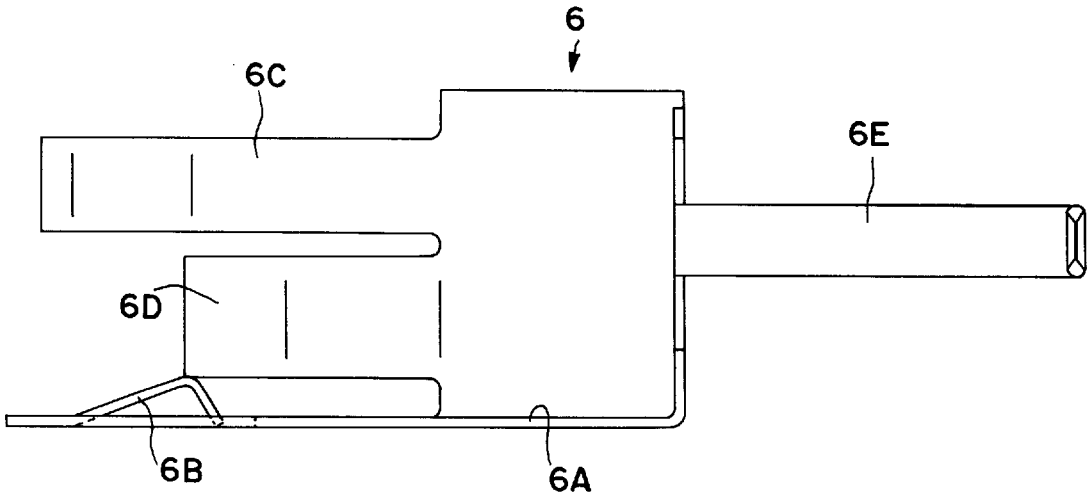
FIG. 4 is a view from the bottom of FIG. 2, showing just the conductive terminal.
Figure 5:
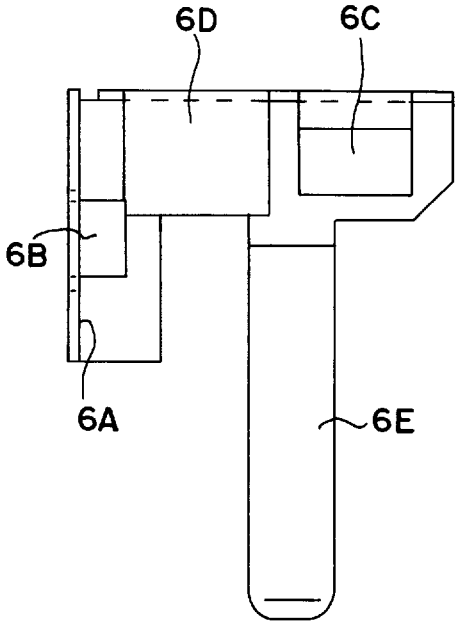
FIG. 5 is a plan view of the conductive terminal.

The assembly as shown in FIG. 2 is inserted into molds K1, K2, and K3 as shown in FIG. 7. Resin is introduced and outer shell 3, outer cylinder 10, and connector insertion portion 16 are formed around core 2. Thus, in this one simple operation, socket 1 is completed.

A second embodiment of the present Invention is shown in FIGS. 8 to 16. Socket 21 includes core 22, outer shell 23, and inner cylinder 24. Outer shell 23 comprises connector receiver 42 with connector insertion opening 43 at one end thereof. Connector terminal 36 projects therein. Conductive terminal 32 is located within inner cylinder 24 and extends through terminal hole 28. Outer cylinder 37 surrounds inner cylinder 24 and circular cylinder 39 surrounds outer cylinder 37 and is of larger diameter so that it is radially spaced therefrom. Electrode terminals 35 are within inner cylinder 24 and terminate adjacent insertion opening 25. At the other end of cylinder 24, shield plate 33 overlies terminal hole 28. Outer cylinder 37, circular cylinder 39, flange 41, and engagement projections 40 make up core insertion portion 38.

Figure 11:
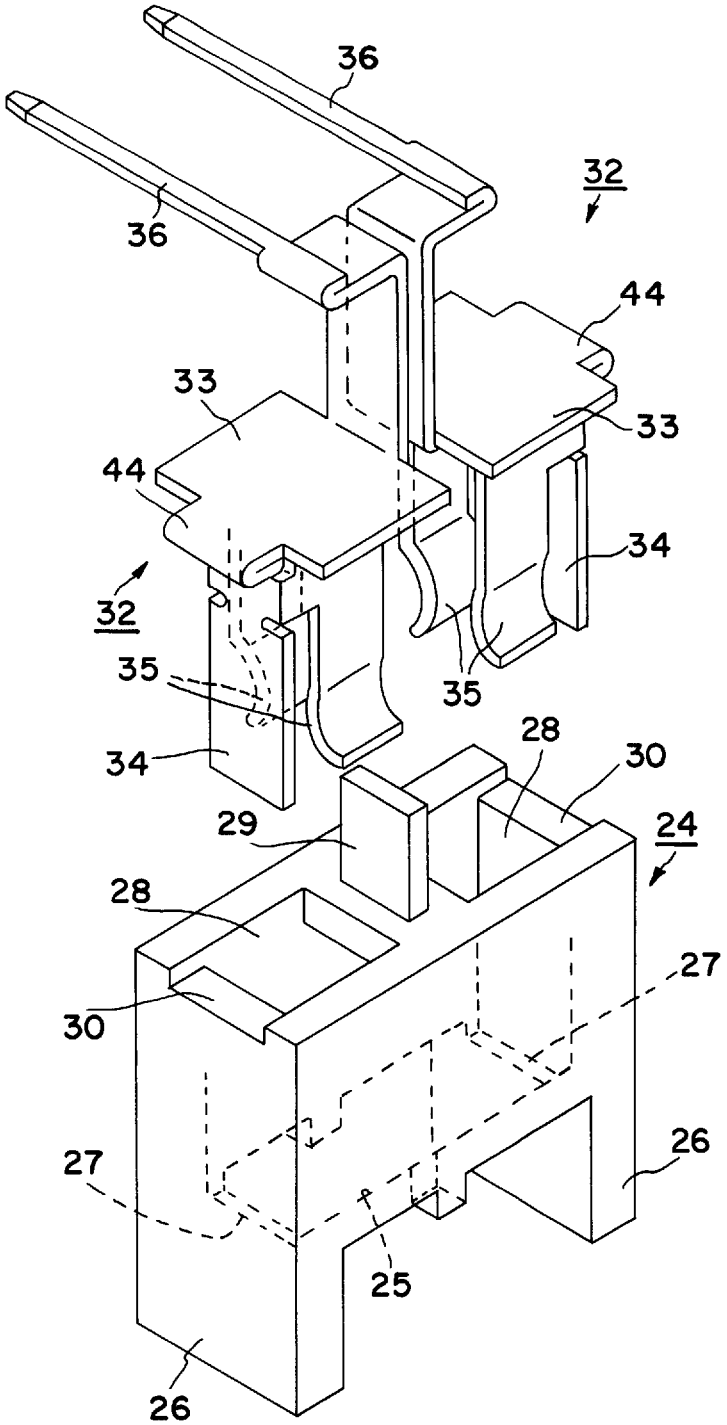
FIG. 11 is an exploded perspective view of the core of the second embodiment of the Invention.

The configuration of conductive terminal 32 and inner cylinder 24 is best shown in FIG. 11. Conductive terminal 32 is provided with connector contacts 36 extending at right angles to the remainder of the terminal. Shield plates 33 have folded portions 44 and are integral with electrode terminals 35 and wall plates 34; the latter are adapted to be located adjacent the inner walls of inner cylinder 24. Cylinder 24 is provided with insets 30 into which folded portions 44 fit. Shield plates 33 overlie terminal holes 28 for protection. The ends of wall plates 34 rest in offset portions 27 on the inner wall of inner cylinder 24. Insertion legs 26 extend from inner cylinder 24 beyond insertion opening 25.

Figure 12:
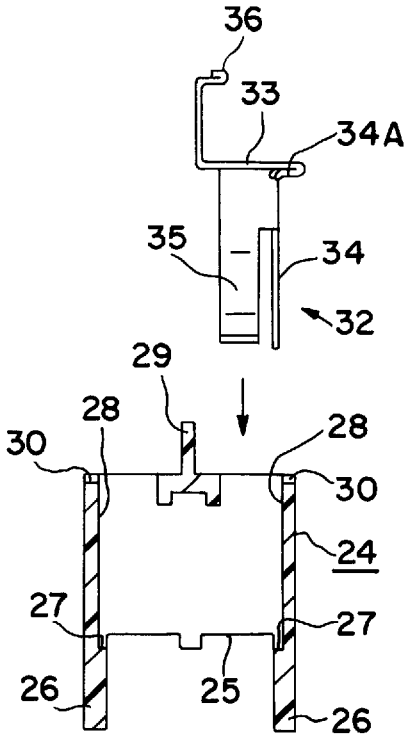
FIG. 12 is a cross section of the conductive terminal and the inner cylinder prior to assembly.
Figure 13:
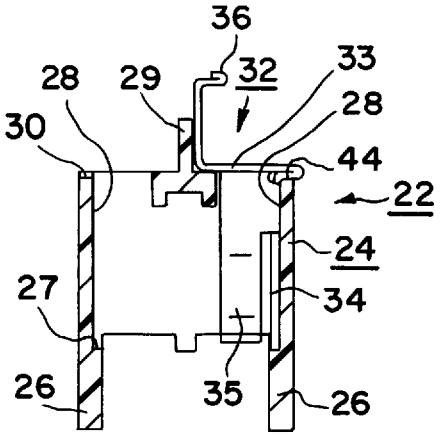
FIG. 13 is a view similar to that of FIG. 12 wherein the conductive terminal and the inner cylinder have been assembled.

Thus, as can be seen in FIGS. 12 and 13, core 22 is assembled by inserting conductive terminal 32 into cylinder 24 through terminal hole 28. Folded edge 44 fits into inset 30 so that shield plate 33 overlies terminal hole 28. The ends of wall plate 34 rest on offset portions 27. In essence, this embodiment of the Invention provides shield plates which protect the terminal hole and comprises electrode terminals 35 which are spring biased toward each other to securely grip the electrical bulb being inserted.

Figure 14:
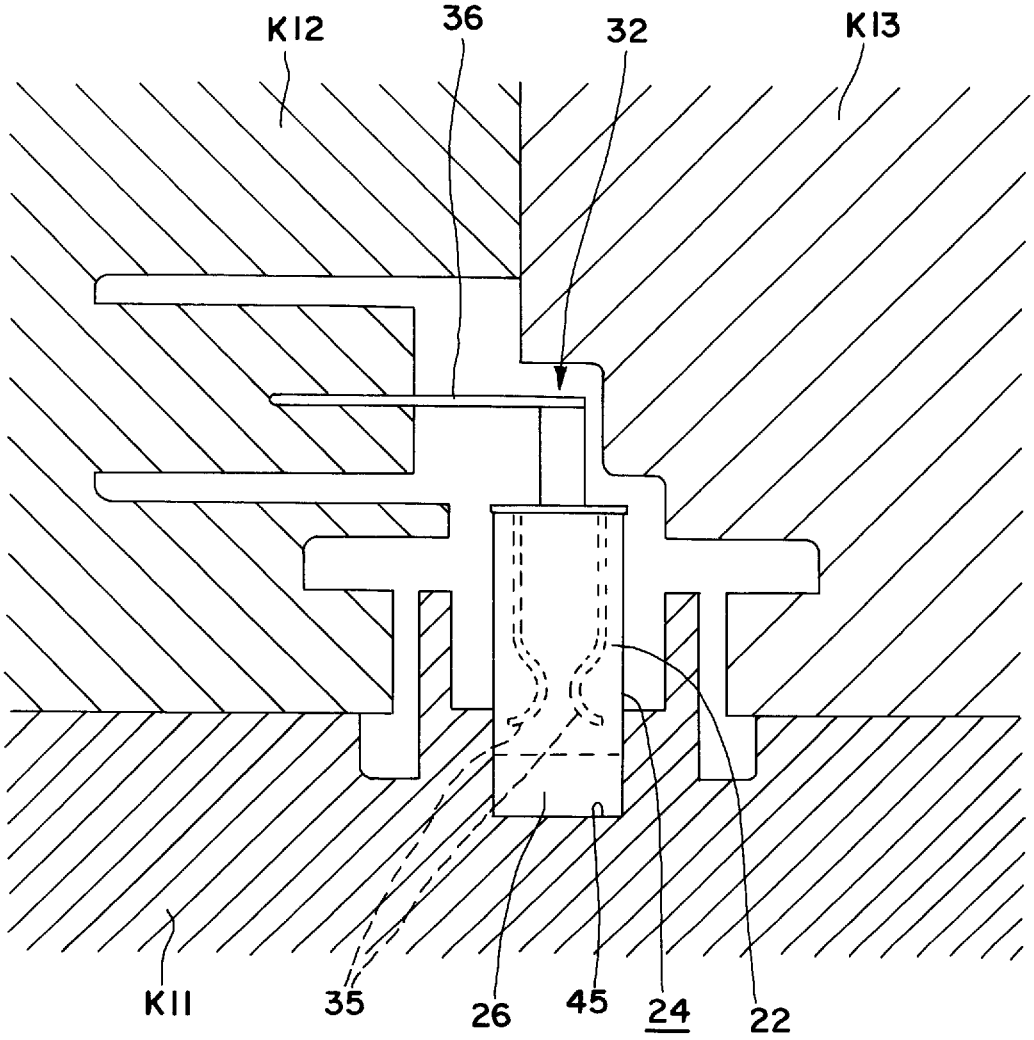
FIG. 14 is a cross section showing the core and conductive terminal mounted inside the mold, before the resin has been introduced.
Figure 15:
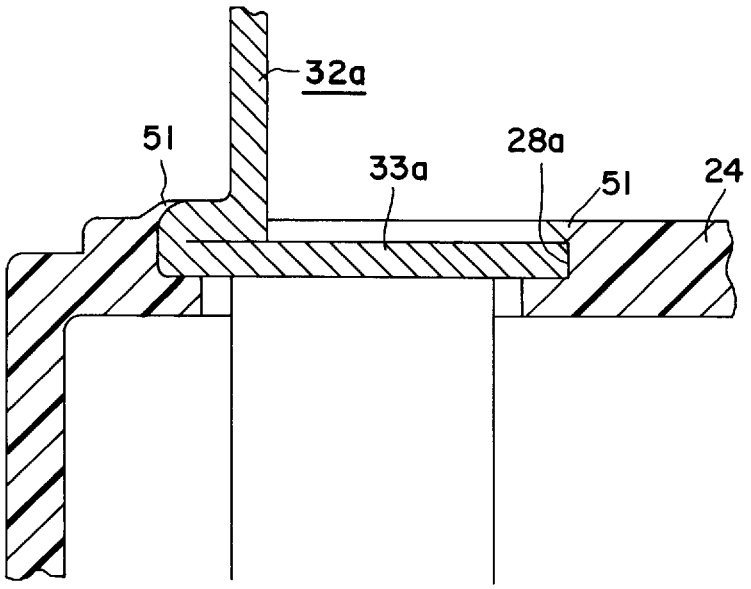
FIG. 15 is a partial cross section of a modification of the second embodiment.
Figure 16:
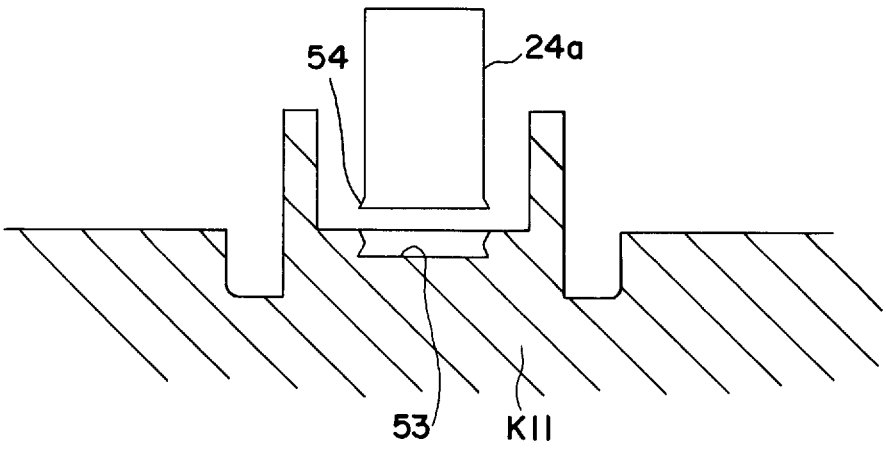
FIG. 16 is a cross section of the mold and the inner cylinder in accordance with a further modification of the second embodiment.

As shown in FIG. 14, insertion legs 26 are introduced into insertion cavity 45 in mold K11 and thereby secure core 22 and electrode terminals 35 therein. Thereafter, molds K12 and K13 are moved into place as shown. Shield plates 33 overlie and protect electrode terminals 35 from contamination by the molding resin.

In a modification of this embodiment (see FIG. 15), inner cylinder 24 is provided with undercuts 51. One edge and the folded portion of shield plate 33 are fitted into undercuts 51, thereby securing shield plate 33 to terminal hole 28.

As an alternative method of manufacture, mold K11 is provided with cylinder mount 53. Inner cylinder 24 is inserted therein. Thereafter, conductive terminal 32 is introduced into inner cylinder 24. In a particularly preferred form of this embodiment, cylinder mount 53 is undercut adjacent its floor. Complementary projection 54 is formed on inner cylinder 24. Thus, projection 54 enters the undercut portion of cylinder mount 53, thereby locking cylinder 24 in place. In this way, insertion molding can be readily carried out without the danger of displacing or overturning inner cylinder 24.

Although only a limited number of specific embodiments of the present Invention have been expressly disclosed, it is, nonetheless, to be broadly construed and not to be limited except by the character of the claims appended hereto.

What we claim is:

1. A socket adapted to receive and make electrical contact with an electrical unit and a connector, said socket comprising a core including an inner cylinder having a cylinder axis and defining an interior space with a unit insertion opening at one end thereof, an electrically conductive terminal including a unit contact with a distal end in said interior space and adjacent said insertion opening, and a connector contact extending through a terminal hole in said inner cylinder, from a proximal end of said conductive terminal remote from said distal end, out of said interior space, and into a connector receiver, which forms of an outer shell which surrounds the inner cylinder said conductive terminal comprising an electrode terminal adapted to contact said unit, a wall plate adjacent an inner side of a wall of said inner cylinder, and a shield plate adjacent said proximal end and completely overlying said terminal hole.

2. The socket of claim 1 wherein said wall is provided with an axially shortened inset adjacent said terminal hole, said shield plate having a folded portion adapted to fit in said inset.

3. The socket of claim 1 wherein there are two of said inner cylinders adjacent each other with their cylinder axes parallel, a partition extending parallel to said axes between said inner cylinders.

4. The socket of claim 1 wherein a cross section of said inner cylinder, perpendicular to said cylinder axis, is a rectangle.

5. The socket of claim 1 wherein there is an offset portion in said wall of said inner cylinder remote from said proximal end, an end of said wall plate remote from said shield plate being in said offset portion.

6. The socket of claim 1 wherein said unit contact comprises a pair of electrodes generally parallel to said cylinder axis and extending from said shield plate toward a floor of said inner cylinder, said electrodes being biased toward each other, thereby making electrical contact with said unit.

7. The socket of claim 1 wherein said conductive terminal is formed from a single piece of flat metal.

8. The socket of claim 3 wherein there is an offset portion in each said interior space, one of said walls plates adjacent an inner side of a respective one of said wall, an end of each said wall plate remote from each said shield plate being in a respective one of said offset portions.

9. The socket of claim 3 wherein each said wall has an insertion leg extending parallel to said cylinder axis in a direction away from a respective one of said shield plates, whereby said inner cylinder and said conductive terminal can be firmly and accurately positioned in a mold to form the outer shell.

10. A method of manufacture of the socket of claim 1, said outer shell having a shell axis shorter than said cylinder axis, said method comprising insertion of said conductive terminal into said inner cylinder and passing said connector contact through said terminal hole to form said core, so that said shield plate overlies said terminal hole, placement of said core in a mold having cavities of the shape of said connector receiver and said outer shell, said mold adapted to receive and retain said core during molding, introduction of molding resin into said cavities, a surface of said mold bearing against said unit opening, whereby said conductive terminal is protected against contact by said molding resin.

11. The method of claim 10 wherein said inner cylinder is provided with insertion legs, said mold is provided with corresponding receptacles for said legs, said legs being inserted into said receptacles after said placement and before said introduction, whereby said core is reliably and accurately retained in said mold.

* * * * *